US005634451A

United States Patent [19]

Tomisawa

[11] Patent Number: 5,634,451

[45] Date of Patent: Jun. 3, 1997

[54] APPARATUS AND METHOD FOR TREATING FUEL VAPOR OF AN ENGINE

[75] Inventor: Naoki Tomisawa, Atsugi, Japan

[73] Assignee: Unisia Jecs Corporation, Atsugi, Japan

[21] Appl. No.: 454,182

[22] PCT Filed: Nov. 18, 1994

[86] PCT No.: PCT/JP94/01959

§ 371 Date: Jun. 15, 1995

§ 102(e) Date: Jun. 15, 1995

[87] PCT Pub. No.: WO95/14165

PCT Pub. Date: May 26, 1995

[30] Foreign Application Priority Data

Nov. 18, 1993 [JP] Japan ..... 5-289030

[51] Int. Cl.[6] ..... F02M 37/04

[52] U.S. Cl. ..... 123/520; 123/516

[58] Field of Search ..... 123/518, 519, 123/520, 521, 516

[56] References Cited

U.S. PATENT DOCUMENTS

| | | | |
|---|---|---|---|
| 4,641,623 | 2/1987 | Hamburg | 123/520 |
| 4,677,956 | 7/1987 | Hamburg | 123/520 |
| 5,048,492 | 9/1991 | Davenport | 123/520 |
| 5,150,686 | 9/1992 | Okawa | 123/520 |
| 5,216,997 | 6/1993 | Osanai | 123/520 |
| 5,263,460 | 11/1993 | Baxter | 123/520 |
| 5,329,909 | 7/1994 | Hosoda | 123/520 |
| 5,363,832 | 11/1994 | Sozumura | 123/520 |
| 5,368,002 | 11/1994 | Hoshino | 123/520 |
| 5,465,703 | 11/1995 | Abe | 123/520 |
| 5,474,049 | 12/1995 | Nagaishi | 123/520 |

FOREIGN PATENT DOCUMENTS

| | | |
|---|---|---|
| 62-7962 | 1/1987 | Japan . |
| 4-1658 | 1/1992 | Japan . |
| 5-10767 | 2/1993 | Japan . |

*Primary Examiner*—Carl S. Miller
*Attorney, Agent, or Firm*—Foley & Lardner

[57] ABSTRACT

A fuel vapor treatment apparatus controls fuel vapor produced in a fuel tank supplied to an engine intake system to prevent dispersion into the atmosphere. It involves adjusting a purge air quantity to a high accuracy, to thereby avoid the occurrence of air-fuel ratio fluctuations between cylinders due to the purge air. More specifically, with a construction wherein the purge air quantity is adjusted by duty controlling the opening/closing of a purge passage, the purge air quantity is set based on the engine load and engine rotational speed, and the control frequency used in the duty control is increasingly changed corresponding to an increase in purge air quantity. Moreover, the opening/closing of the purge passage is duty controlled based on the purge air quantity and the control frequency.

6 Claims, 5 Drawing Sheets

APPARATUS AND METHOD FOR TREATING FUEL VAPOR OF AN ENGINE

TECHNICAL FIELD

The present invention relates to an apparatus and method for treating fuel vapor of an engine. In particular, the invention relates to technology for supplying fuel vapor produced inside a fuel tank, to the engine intake system to thereby prevent diffusion into the atmosphere.

BACKGROUND ART

Apparatus for treating fuel vapor to prevent fuel vapor inside a fuel tank from diffusing into the atmosphere (referring to Japanese Unexamined Patent Publication No. 62-7962), have involved temporarily absorbing the fuel vapor produced inside the fuel tank into a canister, and then purging the absorbed fuel vapor and supplying the purge air through a purge passage to the engine intake system.

With such an apparatus the purge air from a canister is supplied to the engine intake system, with the normal supply mixture. As a fixed quantity of purge air is supplied irrespective of the engine operating conditions, there is the likelihood of a large discrepancy in the air-fuel ratio.

To compensate, the quantity of purge air is changed in accordance with engine operating conditions such as engine load. To achieve this, the purge air quantity is adjusted by duty controlling the ON/OFF switching of a purge control solenoid valve that drives a valve for opening and closing the purge passage, according to a duty ratio corresponding to the purge flow quantity required for the operating conditions.

However, with the duty control of the purge control solenoid valve, when the frequency of the duty control is low, purge air pulsations occur with the opening/closing of the purge passage. As a result, variations occur in the purge air quantity drawn into the respective cylinders causing variations in the air-fuel ratio between the cylinders.

So that the purge air is drawn in uniformly into the respective cylinders, the frequency of the duty control should be as high as possible. However, if a high frequency is used, then the power supply time becomes shorter so that the flow quantity region, where there is a drop in control accuracy due to the valve opening delay time, is enlarged compared to when a low frequency is used. As a result, high accuracy flow quantity adjustment cannot be made in the low flow quantity region.

More specifically, while the solenoid valve has a constant valve opening delay time, when duty control is carried out at a high frequency, the power supply time (valve opening time) is shortened compared to that for control at a low frequency, so that the proportion of the power supply time control region occupied by the valve opening delay time is increased. Therefore, when adjusting a low flow quantity at a high frequency, the power supply time within the valve opening delay time during which the air quantity is unstable is given, making it difficult to adjust a low flow quantity to a high accuracy.

Moreover, with a construction wherein a high frequency that can reliably avoid purge air pulsations is used indiscriminately, since the ON/OFF switching per unit time is increased significantly, then there is the likelihood of deterioration in the life of the valve seat components.

DISCLOSURE OF THE INVENTION

In view of the above situation, it is an object of the present invention, with a construction wherein the purge air quantity is adjusted by a duty control, to suppress variations in purge air intake quantity between cylinders, so as to avoid a deterioration in flow quantity control accuracy, and a deterioration in the life of components.

Accordingly, with the apparatus and method according to the present invention for treating the fuel vapor of an engine incorporating a canister for absorbing the fuel vapor in a fuel tank, purging the absorbed fuel vapor, and supplying the purge air to the engine intake system by way of a purge passage. The purge air quantity supplied to the engine intake system is set based on engine operating conditions, while the control frequency at the time of duty controlling the opening/closing of the purge passage is set in accordance with the set purge air quantity. The opening/closing of the purge passage is then duty controlled based on the set purge air quantity and control frequency.

With such a construction, the purge air quantity is controlled to an appropriate value corresponding to the engine operating conditions by duty controlling the opening/closing of the purge passage, the duty control being carried out at different control frequencies in accordance with the purge air quantity. By changing the control frequency in accordance with the purge air quantity, the variations in purge air intake quantity between the cylinders can be suppressed, so that flow quantity adjustment accuracy can be maintained.

The construction may be such that the frequency of the duty control signal is increasingly set in accordance with an increase in the purge air quantity.

With such a construction, when the purge air quantity is small, the opening/closing of the purge passage can be duty controlled at a relatively low frequency to thereby maintain the adjustment accuracy of the purge air quantity, while when the purge air quantity is large, the opening/closing of the purge passage can be controlled at a relatively high frequency to thereby avoid the variations in purge air intake quantity between the cylinders. The occurrence of air-fuel ratio variations between the cylinders can thus be prevented.

Moreover, the construction may be such that the engine load and engine rotational speed are detected, and the purge air quantity is set based on the detected engine load and engine rotational speed.

With such a construction, the occurrence of changes in air-fuel ratio due to the addition of purge air to the normal mixture can be suppressed, so that deterioration in operability due to the supply of purge air can be avoided.

BEST MODE FOR CARRYING OUT THE INVENTION

Figure 1:
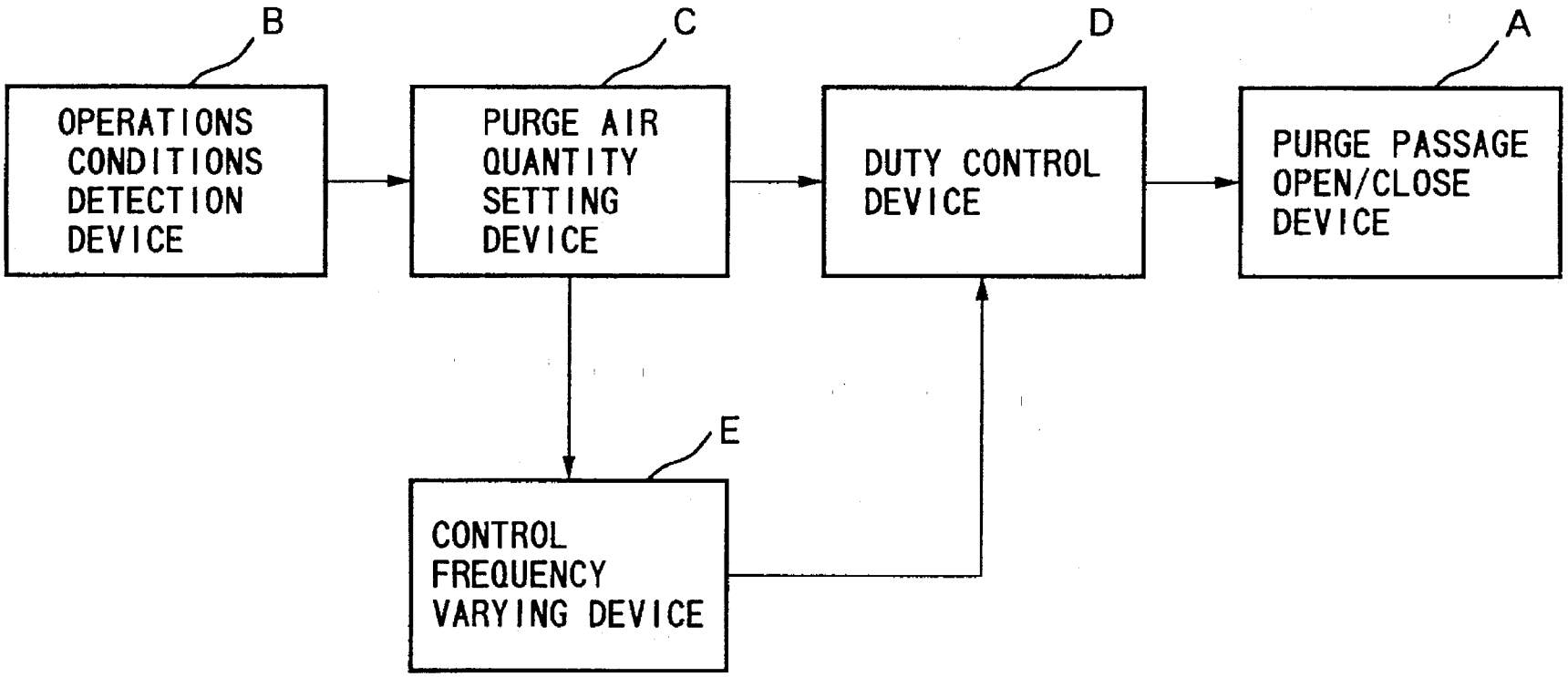
FIG. 1 is a block diagram showing a basic construction of an apparatus for treating fuel vapor of an engine, according to the present invention.

FIG. 1 shows the basic construction of an apparatus for treating fuel vapor of an engine, according to the present invention.

In FIG. 1, a purge passage open/close device A constitutes a device for opening and closing a purge passage, while an operating conditions detection device B constitutes a device for detecting the engine operating conditions.

Moreover, a purge air quantity setting device C sets a purge air quantity supplied to the engine intake system, based on engine operating conditions detected by the operating conditions detection device B, while a duty control device D duty controls the opening/closing of the purge passage open/close device A in accordance with the set purge air quantity.

A control frequency varying device E variably sets the frequency of a duty control signal of the duty control device D in accordance with the purge air quantity set by the purge air quantity setting device C, More specifically, the construction is such that the frequency of the duty control at the time of duty controlling the opening/closing the purge passage is not fixed, but is changed in accordance with the purge air quantity at the time, so that the purge passage open control time proportion in the control frequency is changed.

Embodiments of an apparatus and method for treating the fuel vapor of an engine, according to the present invention will now be described.

Figure 2:
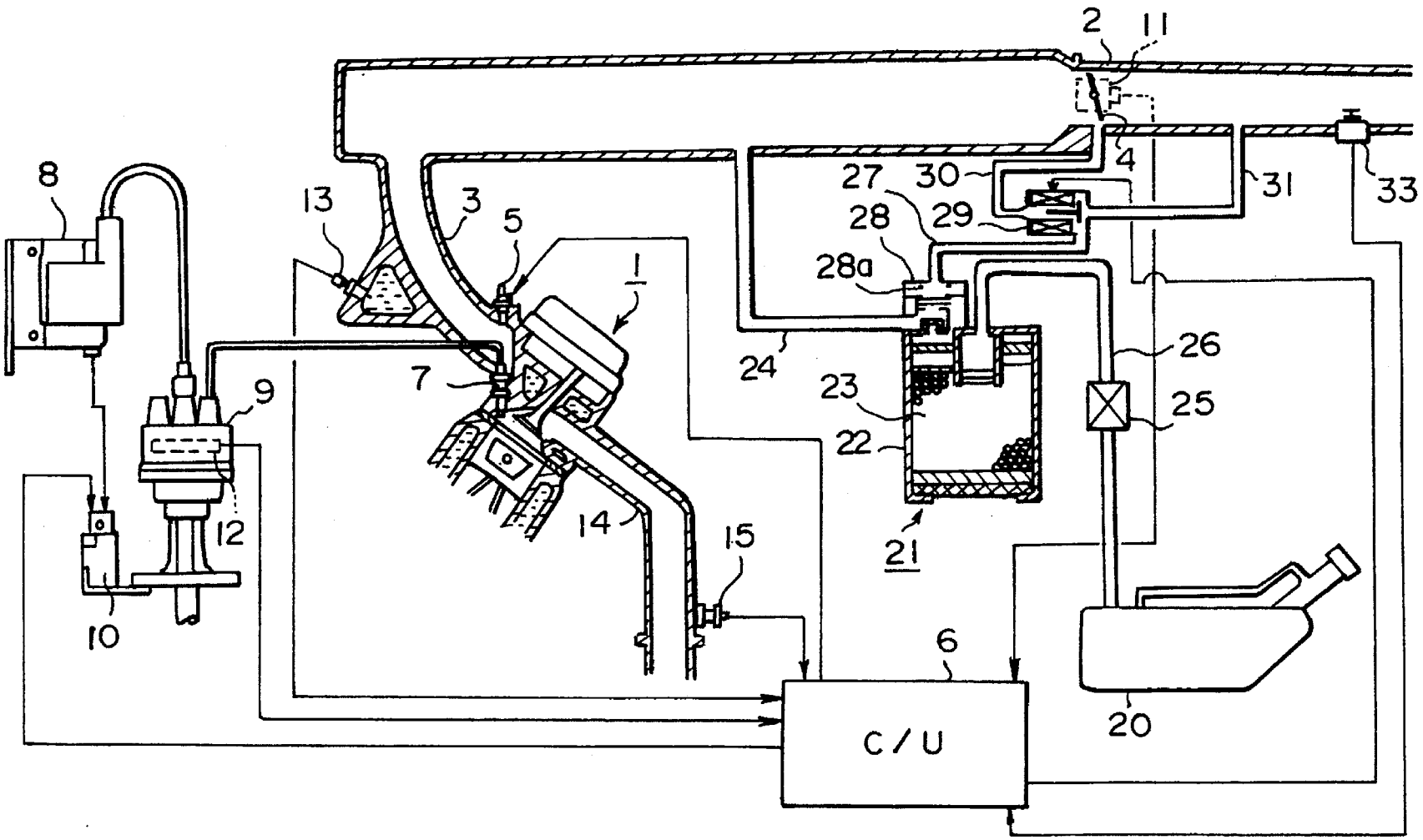
FIG. 2 is a system diagram showing an embodiment of the present invention.

FIG. 2 shows a construction of an embodiment of an apparatus. With this embodiment, air is drawn into an engine 1 by way of a throttle chamber 2 and intake manifold 3.

The throttle chamber 2 is provided with a throttle valve 4 linked to an accelerator pedal (not shown), for controlling the intake air quantity to the engine 1.

Solenoid type fuel injection valves 5 are provided for each cylinder in respective branch portions of the intake manifold 3 for injecting fuel, which has been pressurized by a fuel pump (not shown), and controlled to a predetermined pressure by a pressure regulator, to inside the intake manifold 3.

The fuel injection valves 5 are intermittently driven open in response to an injection pulse signal from a control unit 6 incorporating a microcomputer, and the fuel injection quantity is controlled corresponding to a pulse width of the injection pulse signal computed by the control unit 6.

Respective ignition plugs 7 are provided for each cylinder of the engine 1. A high voltage generated by an ignition coil 8 is applied successively to the ignition plugs 7 by way of a distributor 9 to thereby cause a spark to ignite the mixture. Here the high voltage generation period of the ignition coil 8 is controlled by means of a power transistor 10 attached thereto.

Fitted to the throttle valve 4 is a throttle sensor 11, which detects the opening (TVO) by means of a potentiometer.

Detection signals for each predetermined crank angle are output from a crank angle sensor 12 provided inside the distributor 9. The engine rotational speed Ne can thus be computed based on the detection signals.

A water temperature sensor 13 for detecting a cooling water temperature Tw, is provided in the cooling water jacket of the engine 1, while an oxygen sensor 15 for detecting the concentration of oxygen in the exhaust gases, which concentration is closely related to the air-fuel ratio of the intake mixture of the engine 1, is provided in the exhaust manifold 14. Moreover an air flow meter 33 for detecting an intake air quantity Qa of the engine 1, is provided in the intake duct upstream of the throttle chamber 2.

The engine 1 is furnished with a vapor treatment apparatus 21 for preventing the diffusion of fuel vapor produced inside a fuel tank 20, into the atmosphere.

With the vapor treatment apparatus 21, fuel vapor produced inside the fuel tank 20 is temporarily absorbed into an absorption agent 23 such as activated carbon which is filled into a canister 22. The fuel that has been absorbed into the absorption agent 23 is then purged, and the purge air supplied through a purge passage 24 to the intake passage downstream of the throttle valve 4.

Fuel vapor inside the fuel tank 20 is introduced to the canister 22 by way of a vapor passage where a check valve 25 is disposed, which valve is opened when a positive pressure inside the fuel tank 20 is larger than or equal to a predetermined value. Moreover, disposed in the purge passage 24 is a diaphragm valve 28 incorporating a pressure chamber into which negative throttle pressure or atmospheric pressure are selectively introduced by way of a reference pressure passage 27.

With the diaphragm valve 28, when a negative throttle pressure is applied to the pressure chamber, the purge passage 24 is opened in opposition against the urging force of a valve closing spring **28*a*. When the pressure chamber is at atmospheric pressure, the urging force of the valve closing spring 28*a* closes the valve, thereby closing the purge passage 24**.

A purge control solenoid valve 29 which is duty controlled ON and OFF by the control unit 6, is disposed in the reference pressure passage 27, for selectively applying a negative throttle pressure to the pressure chamber of the diaphragm valve 28.

The construction of the purge control solenoid valve 29 is such that when in an OFF condition (open), a negative pressure passage 30, which introduces a negative throttle pressure, is connected to the reference pressure passage 27, to give a large purge air quantity, while when in an ON condition (closed), an atmospheric pressure passage 31 for introducing atmospheric pressure from upstream of the throttle valve 4, is connected to the reference pressure passage 27, to give a small purge air quantity.

Accordingly, the negative throttle pressure and atmospheric pressure can be alternately introduced to the pressure chamber of the diaphragm valve 28, by ON/OFF switching of the purge control solenoid valve 29. By duty controlling this ON/OFF switching, the purge air quantity adjusted by means of the diaphragm valve 28 can be variably controlled. In this respect, the purge control solenoid valve 29 corresponds to the purge passage open/close device of the embodiment.

Aspects of a canister purge control carried out by the control unit 6 will now be described in accordance with the flow chart of FIG. 3.

Figure 3:
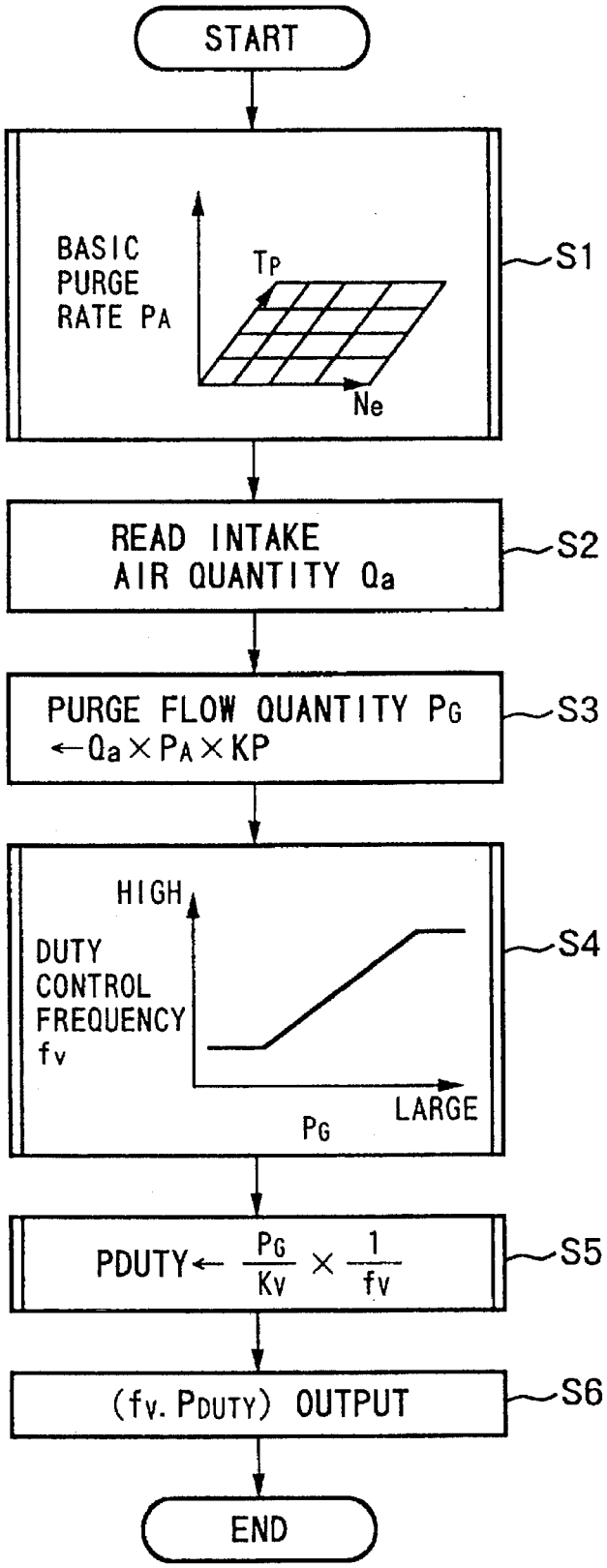
FIG. 3 is a flow chart showing a canister purge control routine in the embodiment.

In the present embodiment, the functions of a purge air quantity setting device, a duty control device, and a control frequency varying device, are realized by software illustrated by the flow chart of FIG. 3 and stored in the control unit 6. Moreover, the operating conditions detection device corresponds to the air flow meter 33 and the crank angle sensor 12.

In the flow chart of FIG. 3, initially in step 1 (with step denoted by S in FIG. 3), a map in which a basic purge rate PA has been pre-stored with parameters of engine load Tp ($Tp=K\times Qa/Ne$; where K is a constant), which is computed based on intake air quantity Qa and engine rotational speed Ne, and engine rotational speed Ne is looked up to obtain a basic purge ratio PA corresponding to the current engine load Tp and rotational speed Ne.

Then in step 2, the engine intake air quantity Qa is read, and in step 3 the basic purge ratio PA is changed using the basic purge ratio PA, the intake air quantity Qa, and a conversion coefficient KP, into a purge flow quantity PG (PG=Qa×PA×KP). Hence with this embodiment, the purge flow quantity PG is determined so that the quantity of purge air supplied is a predetermined proportion of the intake air quantity Qa.

In step 4, a control frequency fv for when the ON/OFF switching of the purge control solenoid valve 29 is duty controlled, is determined based on the set purge flow quantity PC. Here the lower the purge flow quantity PG the lower the control frequency fv.

Since there is the possibility of pulsations of the purge air when the control frequency fv is set comparatively low, then preferably from the point of view of avoiding the purge pulsations, the frequency should be as high as possible.

Figure 4A:
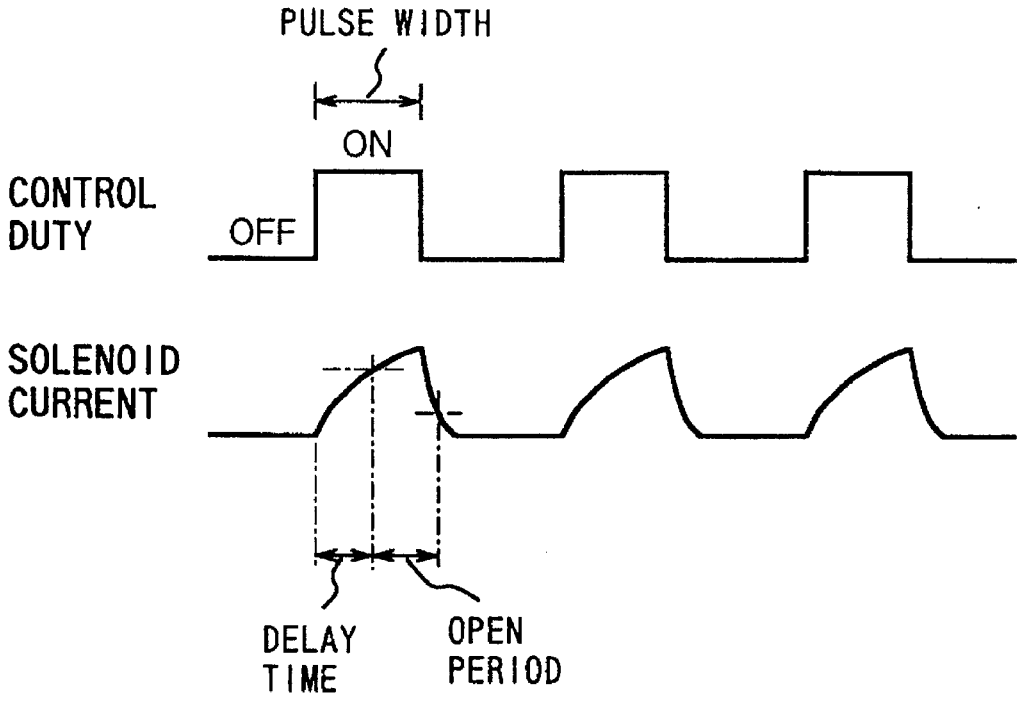
FIGS. 4A and 4B are graphs showing aspects of duty control at high frequency.
Figure 4B:
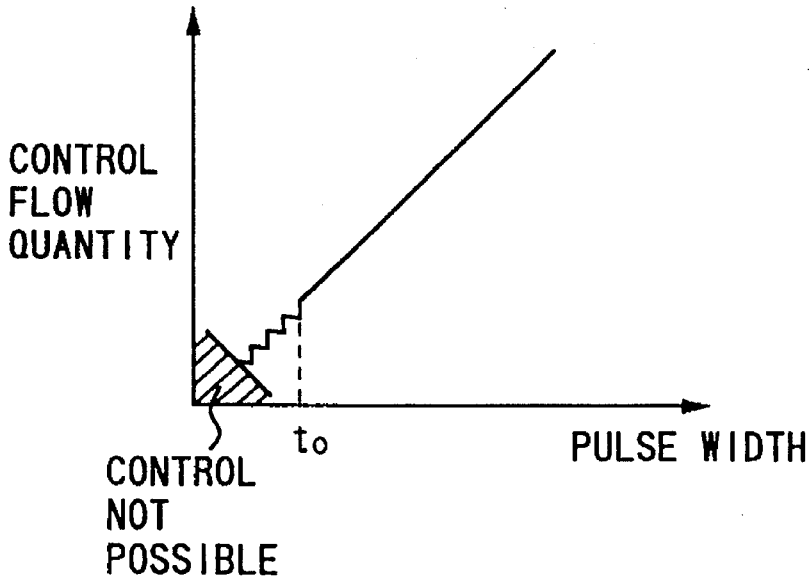

However, with a construction wherein duty control is carried out at a high frequency, then as shown in FIGS. 4A and 4B, due to the shortening of the power supply time, the influence of the valve opening delay time becomes significant so that flow quantity adjustment accuracy drops. Moreover, with the construction wherein duty control is normally carried out at a high frequency, since the ON/OFF switching frequency of the solenoid per unit time is increased, the life of the valve seat components becomes a problem.

Figure 5A:
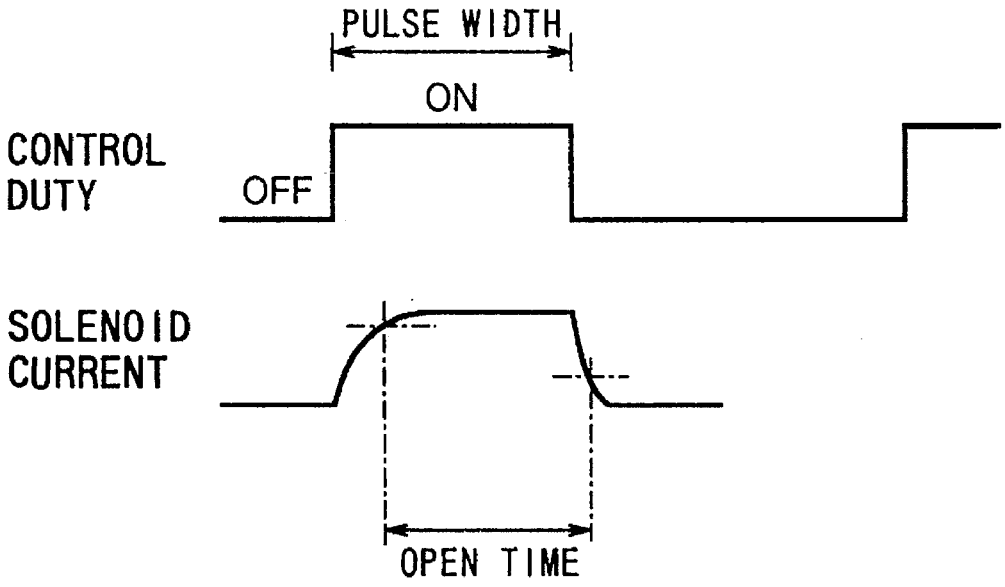
FIG. 5A and 5B are graphs showing aspects of duty control at low frequency.
Figure 5B:
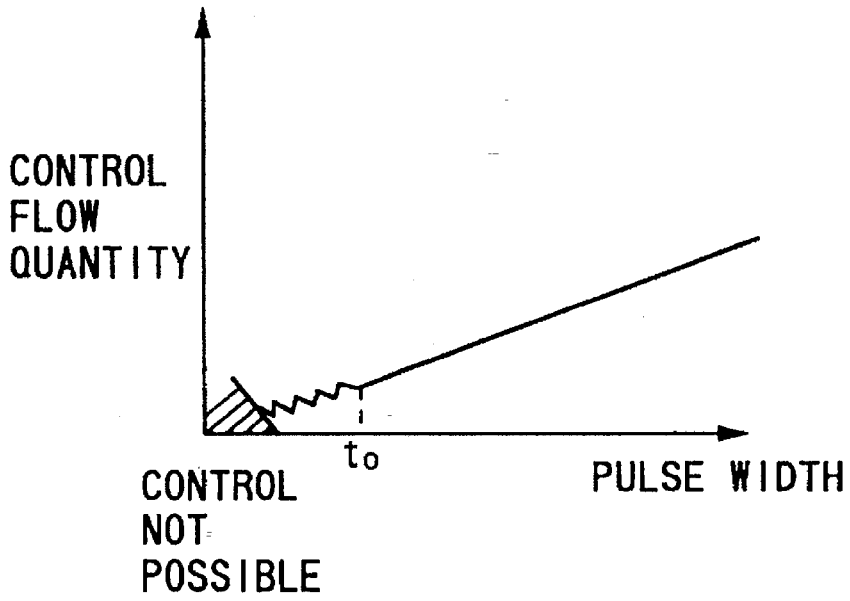

With the present embodiment, with a low flow quantity, the accuracy of flow quantity adjustment is given priority over the avoidance of purge air pulsations. Therefore duty control is made at low frequency (refer to FIGS. 5A and 4B). Since with the low flow quantity the purge air quantity is small, then even in the event of purge air pulsations, any variation in air-fuel ratio between cylinders due to the purge air pulsations will be minimal, so that in this respect duty control at the low frequency presents no problem, or rather the effect that variations in the purge air quantity can be avoided by duty control at a low frequency is important.

With a high flow quantity, the occurrence of pulsations in the purge air can be avoided by high frequency control (see FIG. 4A and 4B), so that the quantity of purge air drawn into the respective cylinders can be made uniform. Moreover with a high flow quantity, the influence of the valve opening delay of the purge control solenoid valve 29 becomes minimal, so that flow quantity adjustment accuracy can also be maintained.

However, when duty control is carried out indiscriminately at a high frequency, the ON/OFF switching frequency by the duty control is significantly increased. Therefore to avoid carrying out duty control unnecessarily at a high frequency, the control frequency is gradually increased in accordance with the increase in required flow quantity. As a result, deterioration in the life of the valve seat components due to high frequency duty control can be minimized.

Once the duty control frequency fv has been set as mentioned above, with the frequency being lower the lower the purge flow quantity PG, then in the next step 5, a control duty $P_{DUTY}$ for the purge control solenoid valve 29 required to obtain the purge flow quantity, is computed as follows:

$$P_{DUTY}=(P_G/Kv)\times(1/fv)$$

In the above equation for computing the control duty $P_{DUTY}$, $K_V$ is the maximum purge flow quantity.

Once the control duty $P_{DUTY}$ has been computed, control proceeds to step 6 where the control duty $P_{DUTY}$ is Output to the purge control solenoid valve 29 at a frequency fv. As a result, the negative throttle pressure introduced to the diaphragm valve 28 is regulated, thereby adjusting the purge air quantity supplied to the engine via the diaphragm valve 28.

In the above embodiment, the frequency fv is variably set based only on the purge flow quantity PG required for the engine operating conditions. However, in priority to this frequency setting, in the injection interval for the fuel injection valves 5 set by the engine rotational speed Ne, the frequency fv may be set so that the ON/OFF switching frequency of the purge control solenoid valve 29 is maintained at the lowest limit. As a result the occurrence of air-fuel ratio variations between the cylinders due to the purge pulsations can be reliably avoided.

With the vapor treatment apparatus 21 of the present embodiment, the construction is such that the purge passage 24 is opened/closed by means of a diaphragm type valve. However, a construction is also possible wherein the purge passage 24 is opened and closed directly with a solenoid valve.

INDUSTRIAL APPLICABILITY

With the present invention as described above, the construction is such that the frequency of the duty control is changed in accordance with the purge air quantity, at the time of duty controlling the opening/closing of the purge passage. Therefore, the accuracy of adjusting the purge air quantity can be maintained so that the occurrence of large fluctuations in the purge air quantity drawn into the respective cylinders, due to the pulsations in the purge air can be avoided.

Accordingly the invention has significant industrial applicability.

I claim:

1. An apparatus for treating fuel vapor of an engine incorporating a canister for absorbing the fuel vapor in a fuel tank, purging the absorbed fuel vapor, and supplying the purge air to an engine intake system by way of a purge passage, said apparatus comprising:

purge passage open/close means for opening and closing the purge passage;

operating conditions detection means for detecting engine operating conditions;

purge air quantity setting means for setting a purge air quantity supplied to the engine intake system based on the engine operating conditions detected by said operating condition detection means;

duty determining means for determining opening/closing duty of said purge passage open/close means in accordance with the purge air quantity set by said purge air quantity setting means;

frequency determining means for determining a frequency of opening/closing of said purge passage open/close means in accordance with the purge air quantity set by said purge air quantity setting means to suppress variations in purge air intake quantity between cylinders; and duty control means for outputting duty control signals of said determined duty and frequency to said purge passage open/close means to duty control the opening/closing of said purge passage open/close means.

2. An apparatus for treating fuel vapor of an engine according to claim 1, wherein said frequency determining means increasingly sets a frequency of the duty control signal in accordance with an increase in the purge air quantity.

3. An apparatus for treating fuel vapor of an engine according to claim 1, wherein said operating conditions detections means detects the engine load and engine rotational speed, and said purge air quantity setting means sets a purge air quantity based on the detected engine load and engine rotational speed.

4. A method of treating fuel vapor of an engine incorporating a canister for absorbing the fuel vapor in a fuel tank, purging the absorbed fuel vapor, and supplying the purge air to an engine intake system by way of a purge passage, said method including the steps of:

detecting engine operating conditions;

setting a purge air quantity supplied to the engine intake system based on the detected engine operating conditions;

determining opening/closing duty of the purge passage based on the set purge air quantity;

setting a frequency of opening/closing of said purge passage based on the set purge air quantity to suppress variations in purge air intake quantity between cylinders; and controlling the opening/closing of said purge passage based on the set purge air quantity and frequency.

5. A method of treating fuel vapor of an engine according to claim 4, wherein the opening/closing frequency of the purge passage increases with an increase in the purge air quantity.

6. A method of treating fuel vapor of an engine according to claim 4, wherein said step for detecting the engine operating conditions detects the engine load and engine rotational speed, and said step for setting a purge air quantity sets a purge air quantity based on the engine load and engine rotational speed.

* * * * *